United States Patent [19]

Weiss

[11] Patent Number: 4,674,201

[45] Date of Patent: Jun. 23, 1987

[54] FOOT SUPPORT

[76] Inventor: Robert F. Weiss, 350 Barrack Hill Rd., Ridgefield, Conn. 06877

[21] Appl. No.: 698,575

[22] Filed: Feb. 6, 1985

Related U.S. Application Data

[63] Continuation-in-part of Ser. No. 520,994, Aug. 8, 1983, abandoned, which is a continuation-in-part of Ser. No. 270,983, Jun. 5, 1981, abandoned.

[51] Int. Cl.[4] ..... A43B 13/38; A43B 13/41

[52] U.S. Cl. ..... 36/43; 36/44; 128/585

[58] Field of Search ..... 36/43, 44, 88, 91, 71; 128/581, 595, 596, 81 R

[56] References Cited

U.S. PATENT DOCUMENTS

| | | | |
|---|---|---|---|
| 2,261,041 | 10/1941 | Tennant | 36/95 |
| 2,415,580 | 2/1947 | Davis | 36/88 |
| 2,531,851 | 11/1950 | Kiwao | 128/81 R |
| 3,211,142 | 10/1965 | Neu | 128/81 R |
| 3,766,669 | 10/1973 | Pearsall | 36/30 R |
| 4,056,106 | 11/1977 | Salvatore | 128/583 |
| 4,216,778 | 8/1980 | Weiss | 128/581 |
| 4,224,750 | 9/1980 | Delport | 36/91 |
| 4,240,214 | 12/1980 | Sigle et al. | 36/43 |
| 4,316,332 | 2/1982 | Giese et al. | 36/114 |
| 4,317,293 | 3/1982 | Sigle et al. | 36/71 |
| 4,481,726 | 11/1984 | Phillips | 36/30 R |
| 4,517,981 | 5/1985 | Santopietro et al. | 128/581 |

*Primary Examiner*—Werner H. Schroeder
*Assistant Examiner*—Steven N. Meyers
*Attorney, Agent, or Firm*—Finnegan, Henderson, Farabow, Garrett and Dunner

[57] ABSTRACT

A foot or fifth toe support for any shoe but primarily for running and jogging shoes, consisting of a flat, flexible and resilient member located below the fifth proximal phalanx from the metatarsal-phalanx joint to the proximal phalanx neck. This support lies independently on the upper surface of a conventional shoe sole or it may be an extension of a semi-rigid orthotic device contoured and dimensioned to cradle the sole and heel to a line across the foot near the distal ends of the metatarsal bones.

6 Claims, 5 Drawing Figures

FOOT SUPPORT

RELATED APPLICATIONS

This is a continuation-in-part of copending application, Ser. No. 520,994, filed Aug. 8, 1983, now abandoned, which in turn is a continuation-in-part of application Ser. No. 270,983, filed June 5, 1981, now abandoned.

BACKGROUND OF THE INVENTION

The present invention relates to a fifth (little) toe support primarily within sport shoes such as running or jogging but also applicable to walking shoes. The support is made of essentially flexible and resilient material that is placed only under the proximal portion of the fifth proximal phalanx or it may be an extension of a semi-rigid foot support extending from the heel to the forward edge of the metatarsal bones. In either case, this fifth ray extension terminates distally underneath the neck portion of the fifth proximal phalanx to improve stability and forward balance.

Running and jogging present different and more critical problems in foot biomechanics than does the normal walking operation. In the running gait with contact, midstance, propulsion and swing phase, there is a shifting of varying degrees, the torque peaks at the end of midstance and the supernation and pronation forces on the foot are greater. Thus the maximum forces occur in the forefoot area.

A runner with the greatest continuity of motion will be one with a normal foot that produces linear shear forces against the foot during contact and again during propulsion. Lateral sheer forces—side to side—motion of the trunk are generally not as significant during normal walking locomotion. However in running and jogging they may have a greater effect, and may be accentuated by any of several pathological conditions which exaggerate lateral motion such as lateral imbalance.

When a person runs, in each stride the ball of the foot, and particularly the portion of the ball of the foot at the little toe, of the forward foot touches the ground first, then the foot rolls forward shifting weight forward onto the toes which bend and unbend as the person's body moves forward over and beyond the toes. This bending and unbending of the toes produces a springy forward functional thrust to the forward motion of the running body. As the person's weight moves forward from the ball of the foot onto the toes, the foot rotates slightly inward due to the staggered arrangement of the toes and the contour of the ball of the foot. This inward rotation is a natural part of the foot movement which enables each toe in succession, beginning with the little toe, to contribute its own component of springy forward thrust. However, if the foot is laterally imbalanced, or if the metatarsal bone which precedes the little toe is unnaturally short, there will be insufficient inward rotation for the most efficient forward thrust, or worse, there will be outward rotation which tends to throw the body off balance, impeding efficient motion or perhaps even causing a sprain or a pulled muscle.

FIELD OF THE INVENTION

The field of this invention is construction of modified corrective human foot support for any shoe but primarily for sports shoes such as running and jogging shoes.

PRIOR ART

The study of the foot in walking and the construction of devices to correct various pathological conditions are well known. Various arch supports designed generally for walking add little or nothing to help running. Amont these corrective appliances, including arch supports for correcting flat feet, are (1) a platform to relieve strain and permit toe gripping (Davis U.S. Pat. No. 2,415,580), (2) a metatarsal edge or longitudinal arch support (Davis U.S. Pat. No. 4,224,750), (3) a support designed to force bending of the big toe during walking by flexing at the hallux joint (Sigle U.S. Pat. No. 4,240,214), and (4) a support designed to shift or roll the foot in the direction of the big toe by lowering the ball of the big toe in relation to the ball of the little toe (Sigle U.S. Pat. No. 4,317,298).

Delport U.S. Pat. No. 4,224,750 discloses a foot support contoured to the sole that terminates at its distal edge near the joints of the five metatarsal bones to the proximal phalanges, but distally of at least some of the joints.

The foot support of Sigle U.S. Pat. No. 4,240,214 mentioned above, also provides an extension in the vicinity of, but not solely under the fifth phalanx. The primary support minus the extension does not terminate at the joints shown by Delport and the extension itself is wedge-shaped, thus laterally forcing the little or fifth toe toward the other toes.

SUMMARY OF THE INVENTION

The present invention is different from prior inventions in that it provides forwardly extending support from the fifth metatarsal or ray. The function of the fifth ray during locomotion is not entirely understood (see Root et al., *Clinical Biomechanics—Normal and Abnormal Function of the Foot,* vol. 2, p. 53 (L.A. Calif. 1977, Clinical Biomechanics Corp.), but it appears that a fifth ray extension support may be utilized to project and extend forward push-off and thrusting, disperse shock and retard lateral forces by facilitating athrometric function of the joints in the forefoot. This novel stabilization system directs the foot action in a forward extended position for the most efficient and least stressful manner for producing motion.

Based upon analysis the fifth ray extension differs from the prior art in optimizing vectors at two axes of motion in the midtarsal joint (midfoot), an oblique axis passing from the lateral to plantar, posterior to anterior, and medial and dorsal. It allows motion of the forefoot upon the rear foot without (or free of) any motion at the rear foot, abduction, eversion, and dorsiflexion of the forefoot and adduction, inversion and plantarflexion. The primary motion around this longitudinal axis is inversion/eversion, slightly abduction/adduction, plantarflexion and dorsiflexion. All of these axes are pronation-supination axes.

The key point in the foot which gives the greatest range of dorsiflexion is the oblique axis of the midtarsal joint or midfoot. This fifth ray extension uses the oblique axis vector forces as well as utilizing muscle dynamics of the lumbricalis and interossei muscles which insert into the proximal phalanges-base and head areas, which is the key factor of the anatomical position of the fifth ray extension and is most functional at the neck of the proximal phalanx where the muscle action has greatest motion as a movement arm of a muscle-tendon apparatus (the length of the tendon from its pulley to insertion). A short movement arm has greater motion, as in this fifth ray extension, than a long movement arm, the latter of which may create rolling motion.

It is the primary object of the invention to provide a support which will provide a forward thrust and stability at the fifth ray without excessive pronation.

To achieve this object the invention provides for a flat member made of flexible resilient material beginning near the distal end of the fifth metatarsal and extending forwardly to the proximal phalanx neck. The material is of such strength that it does not fully collapse under the body's weight in propulsion and the small toe is curved over during midstance and propulsion as a lever. The member forms a stabilization system that directs the foot action forward simultaneously with all lesser digits in a stable forward recovery-extended position for the most efficient and least stressful manner for producing motion. The extension is flat but the thickness may, but need not necessarily, be made such as to compensate for functional lateral imbalance as measured across the foot at the distal portion of the metatarsals.

Preferably, the remainder of the foot proximal to the proximal phalanges is also supported by a member contiguous and/or integral with the fifth ray extension. This foot support will be of semi-rigid material, thus providing a pivotal movement of the extension relative to the support.

Further objects, advantages and features of the foot support of this invention will be apparent from the following more detailed description of an illustrative embodiment of the invention shown in the accompanying drawings in which:

DESCRIPTION OF THE PREFERRED EMBODIMENT

Figure 1:
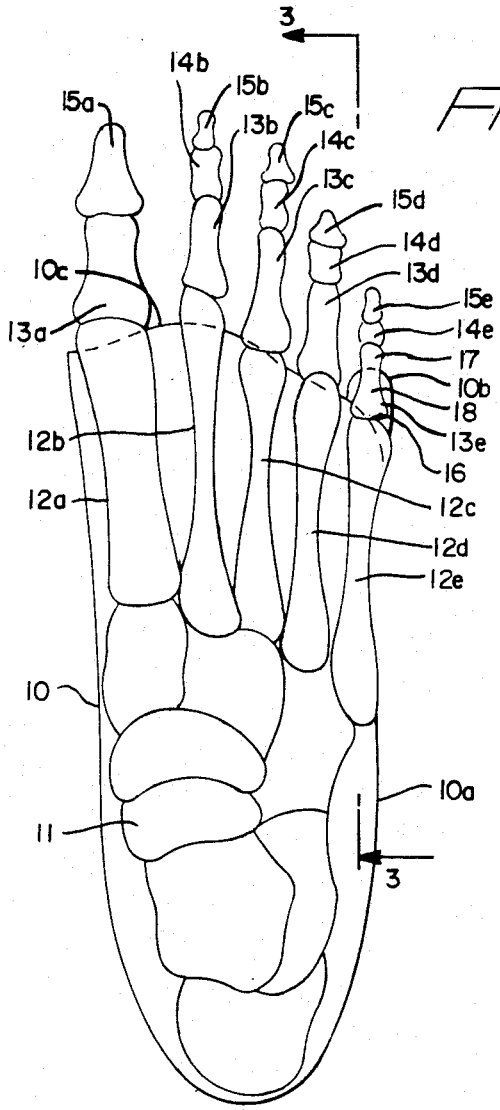
FIG. 1 is a top plan view of the skeleton structure of a right foot showing the relative size, shape and position of the full support embodying the invention.
Figure 3:
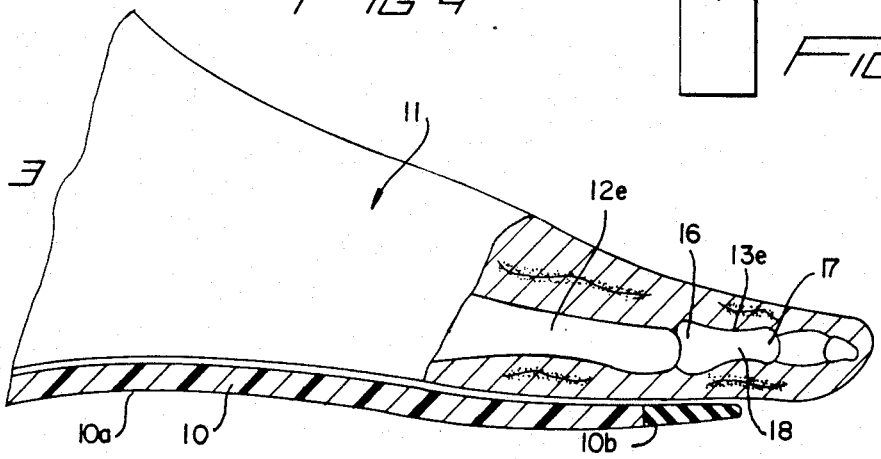
FIG. 3 is a longitudinal vertical section taken along line 3—3 of FIG. 1.

The bone structure of a person's right foot 11 and the foot support 10 therefor are shown in FIGS. 1 and 3. Left foot positions and contours would be reversed.

Foot 11 has five metatarsal bones 12, shown as 12*a* for the first metatarsal on the inside foot edge, then second 12*b*, third 12*c*, fourth 12*d*, and finally the fifth 12*e*, at the outside edge. The principal bones of the toes are the proximal phalanges 13*a* to 13*e* which extend forwardly in line from the respective metatarsal bones 12*a* to 12*e* to which they are joined by flexible joints at the toe bases. The other toe bones are the middle phalanges 14*b* to 14*e* and the distal phalanges 15*a* to 15*e*, the large toe having no middle phalanx.

Each proximal phalanx, as shown herein only for the fifth phalanx, is composed of a base 16 at the proximal end, a head 17 at the distal end and a neck 18, which is that elongated portion between the head and base where a section would have less area than the greatest sectional area of the head or base.

Figure 2:
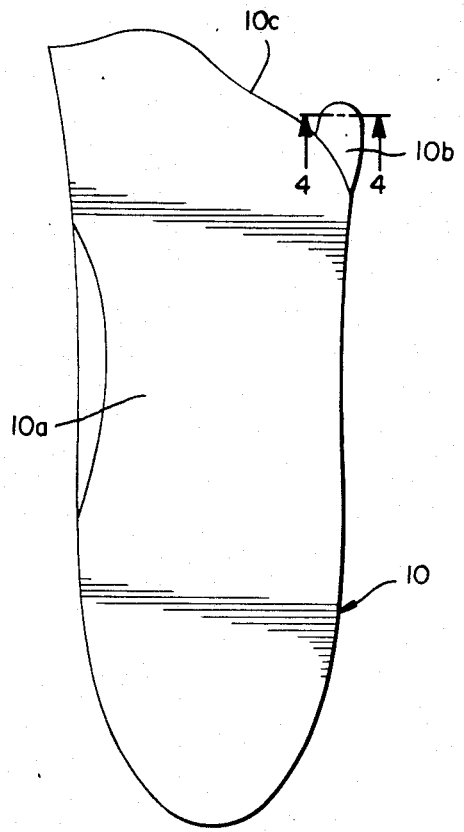
FIG. 2 is a top plan view of the support shown in FIG. 1.
Figure 4:
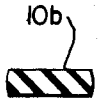
FIG. 4 is a horizontal section taken along line 4—4 of FIG. 2.
Figure 5:
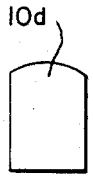
FIG. 5 is a plan view of an independent fifth toe support.

The fifth ray extension shown in FIG. 5 alone is 10*d* or in FIGS. 1, 2 and 3 as a continuous extension 10*b* of foot support 10. In either case the extension terminates distally beneath the fifth proximal phalanx neck as defined before. The proximal end of the extension 10*b* terminates at its junction with body portion 10*a* of the foot support. The proximal end of the independent extension 10*d* terminates near, slightly proximal to, or up to 5 to 10 millimeters proximal to, the metatarsal-phalanx joint.

Support portion 10*a* is substantially rigid or stiff and made of any suitable material such as fiberglass reinforced plastic or resin impregnated with graphite and conforms to the contour of the sole of the foot as shown in FIG. 1. The toe supports 10*b* and 10*d* are more flexible and resilient than foot support 10*a*, may be made of rubber and provide a lever pivot arrangement relative to foot support 10*a*.

The forward edge 10*c* of the foot support 10 extends across under the foot along a line generally at the forward ends of the metatarsal bones 12*a* through 12*e*, i.e. the joints between the metatarsal bones and the proximal phalanx bones 13*a* through 13*e*, as indicated by line 10*c* in FIG. 1. This line should be near the joints, preferably proximal thereto, and may extend proximally from the joints up to a centimeter, preferably to about 5 millimeters.

The member or extension 10*b* may be attached to the support 10*a* at the edge 10*c* or extend slightly under the body thereof to provide additional surface for adhesion. Any means of attaching the materials used in 10*b* or 10*a* may be used. It may also be a part of a layer of flexible resilient material applied over the entire sole 10 with a member extending to form 10*b*. Thus the desired contour can be provided in many fashions.

The thickness of the extension 10*b* may, but need not, be made such as to compensate for degrees of lateral imbalance as measured across the midportions of the proximal phalanges 13. The extension 10*b* having some thickness does compensate in any event for lateral imbalance at the midportions of the phalanges. The extension should be flat and as wide or somewhat wider than the fifth phalanx but not reach the fourth phalanx.

When a person runs, the extensions 10*b* and 10*d* provide a dynamic thrust forward. As the foot 11 rolls forward during a running stride as in the ideal movement of a correctly balanced foot, the supported foot rotates slightly inward and in sequence from the little toe to the big toe to bend and then unbend as the body moves forward over and beyond the foot. The bending and unbending of the toes in staggered sequence provides springy forward thrust. The slight inward rotation of the foot is due to the contour of the ball of the foot and the staggered relation of the toes, and cooperates with the toe bending and unbending to thrust the body forward in a straight line.

In the absence of effective dynamic correction outward, rotation or insufficient inward rotation of the foot causes the thrust provided by the feet during running to oppose rather than coincide with the movements of the rest of the person's body, thereby dissipating forces and reducing the efficiency of the running effort.

The extensions 10*b* or 10*d* of this invention by extending under the fifth proximal phalanx to the neck thereof operates effectively during running to prevent unwanted outward rotation or excessive pronation of the foot, to assure sufficient degree of the desired inward rotation. Moreover, the flexible and resilient extension does not inhibit the thrust provided by the bending and unbending of all the toes in sequence and thus maximizes effective foot and body motion for running as a spring lever.

I claim:

1. A foot support structure comprising:

base means conforming generally to the contour of the sole of a human foot; and means attached to said base means extending substantially only under the fifth phalanx of said foot for compensating for lateral imbalance of said foot by establishing an effective amount of inward rotation of said foot for efficient forward thrust and preventing outward rotation of said foot during running for maximizing effective foot and body motion for running.

2. The support structure of claim 1 wherein said extending means extends from said base means to about the midportion of the fifth phalanx of said foot.

3. The support structure of claim 1 wherein said base means is substantially stiff.

4. The support structure of claim 1 wherein said extending means is resilient for maximizing the effective forward thrust provided by the bending and unbending of the toes of said foot during running.

5. The support structure of claim 1 wherein said extending means has a thickness sufficient to compensate for lateral imbalance of said foot as measured at a line across said foot at the midportions of the phalanx bones of said foot.

6. The support structure of claim 1 wherein said support structure is incorporated in a support for insertion into a shoe.

* * * * *